United States Patent [19]

Augostini

[11] Patent Number: 4,610,386

[45] Date of Patent: Sep. 9, 1986

[54] STAPLER HAVING A VARIABLE STOP MEMBER FOR LIMITING STAPLING STROKE AND STAPLE LEG LENGTH

[75] Inventor: Carl W. Augostini, Fairport, N.Y.

[73] Assignee: Xerox Corporation, Stamford, Conn.

[21] Appl. No.: 203,739

[22] Filed: Nov. 3, 1980

[51] Int. Cl.[4] ..... B25C 5/02; B25C 7/00

[52] U.S. Cl. ..... 227/142; 227/131

[58] Field of Search ..... 227/131, 142; 222/309

[56] References Cited

U.S. PATENT DOCUMENTS

| | | | |
|---|---|---|---|
| 2,706,293 | 4/1955 | Moore | 227/131 |
| 3,016,538 | 1/1962 | Oussani | 227/142 X |
| 3,314,581 | 4/1967 | Kapitanov et al. | 227/142 |
| 3,641,652 | 2/1972 | Arnold et al. | 227/142 X |
| 3,758,005 | 9/1973 | Christine et al. | 222/309 |
| 4,142,654 | 3/1979 | Doubleday et al. | 222/309 |

*Primary Examiner*—Fred Silverberg

*Attorney, Agent, or Firm*—Bernard A. Chiama

[57] ABSTRACT

A stapler apparatus having a member for limiting the angular relationship between a fixed base member and the pivotal magazine therefor. The limiting member includes a stepped stop member positionable between the base member and magazine, and is formed so that different angular relationships may be obtained. For each angular relationship, the bending of preformed staple legs is controlled so as to permit the use of the same size of staples for a few sheets in a set of sheets being stapled.

3 Claims, 3 Drawing Figures

STAPLER HAVING A VARIABLE STOP MEMBER FOR LIMITING STAPLING STROKE AND STAPLE LEG LENGTH

This invention relates to improvements in fastener applying apparatus for attaching sheets of paper. The present invention is particularly applicable to stapling devices, finishers and the like which are associated with copying machines having a finishing assembly which receives finished copy sheets in collated sets, are jogged and then stapled or stitched for use by an operator.

In conventional copy machines which employ staplers or finishing apparatus, problems have arisen when attempts are made to utilize the stapler or fixing device or copy sets which range from a two sheet set up to sets which include 30 or more sheets of paper. In commercial machines having stapling devices, use is made of various sizes of staples wherein staples with long legs are used for sets having a relatively large number of copy sheets, and short legged staples are utilized for the lower range of the number of copy sheets. In between these two extremes of the number of sheets there may be other sizes of staples utilized. In these situations, the operator must either remove all of the staples from one or more of the staples associated with the copying machine and insert quantities of staples of the size more compatible to the number of sheets in the set for which he is preparing to produce. This entails removing perhaps thousands of staples from each of the stapling devices associated with the machine and reinserting great quantities of the desired staple.

The alternative to incorporating procedures and apparatus for effecting staple size changes is to neglect or refrain from making changes in staple sizes. In this situation, the machine utilizes a standard size staple, one having relatively long legs for the maximum number of sheets in a set the copy machine is adapted to collate. When the copy machine is programmed then to produce sets containing 2, 3, 4, or 5 sheets and use is maintained for the long legged staples, the staples will repenetrate such set during a stapling operation and the legs wll protrude outwardly from the top sheet of the set thus presenting a very unsightly stapled set. In addition, with the two relatively sharp tips of the staple protruding through the top sheet, there is great likelihood the recipient of a set will puncture the skin of his fingers in handling the set. Furthermore, when a number of sets having this condition of the staples are piled one upon the other such as in a file folder, the corner of the set having the staples becomes rather bulky and more than likely may even damage the edges of other papers in the file.

Another alternative, of course, is to utilize a relatively sophisticated active clinching device along with the stapler. These devices add considerable cost and complexity to a stapling apparatus and increases the incidences of malfunction.

Therefore, the principal object of the present invention is to improve stapling capability of a stapler device in handling thin sets of sheets, say on the order of two to five sheets, as well as thick sets, on the order of 20 or more sheets.

Another object of the invention is to improve the range of applicability of a stapling device without increasing its cost of manufacture or the necessity of providing sophisticated engineering techniques in developing an improvement to the device.

Further objects and advantages of the present invention are set forth or will appear from the following specification which describes a preferred form of the invention by way of example and is illustrated by the accompanying drawings wherein.

Figure 1:
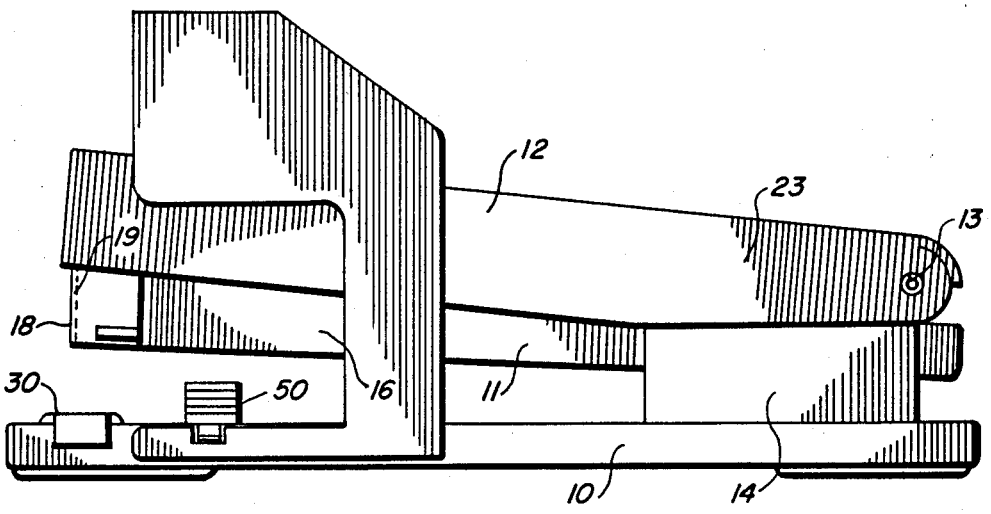
FIG. 1 is a side elevational view of a power operated stapling apparatus embodying the principles of the present invention.

In the accompanying specification and drawings, the staple apparatus disclosed for which the present invention is embodied is an electromechanically operated implement such as an ordinary commercial desk-type stapler. It is to be understood that this utilization is only for exemplary purposes and that the stapling apparatus of the present invention is also applicable to other finishing stapler heads utilized in conjunction with a copying machine.

The disclosed stapling apparatus also is shown as applicable to U-shaped staples which are commercially available in the market and which assume various sizes which generally differ in the length of the legs of the staples. The present invention is also applicable to any other configuration of a staple other than a U-shaped form; such, for example, for use with ribbon form of packaging for staples. In this latter form the staples are not bent into a U-shape but rather are presented in a stapling apparatus in straight elongated configuration and are tied together along their mid-portions by glue or very thin frangible ribbon material.

In general, the stapling apparatus to which the present invention is embodied comprises a relatively flat, rectangular base 10, a staple magazine 11 pivoted above the rearward end of the base member and a driver operated lever 12 pivoted upon a yoke, secured upon the base member by way of a pivot pin 13 which also serves to pivot the magazine member relative to the driver member. A solenoid SOL-1 having a plunger 15 operable upon the driver member at the forward end thereof is shown only schematically since power operated stapling apparatus are well known in the art.

The magazine 11 is preferably constructed of sheet metal formed into a trough-shaped, elongated channel with upstanding sides 16 and closed at its forward end by a vertical wall 18 which limits the removal of staples S from the magazine when contained therein. At this forward end of the magazine, a cutaway 19 is formed as an open guideway for the egress of staples when driven out of the stapler device.

A stick of staples S is received in the magazine in the conventional manner and a slipper 20 is also provided in the magazine or urging the stick S forward against the stop 18 to maintain the outermost staple in alignment with the guideway 19. The slipper 20 is slidably mounted in the magazine and is urged forward therealong by a helical spring 21 held in compression between the adjacent end of the slipper and the rear wall (not shown) of the magazine.

The driver lever 12 may also be constructed of sheet metal and formed to provide depending sides 23 which slidably retain the end walls 16 for the magazine 11. A substantially vertical blade-like element 25 secured to the forward end of the driver member forms the driver for the stapling apparatus and is slidable in the guideway 19 at the adjacent forward end of the magazine 11. In this conventional construction of the stapler device already described, initial downward rotation or pivoting of the driver member 12 which carries the magazine 11 therewith, is eventually arrested when the magazine engages the stapler anvil 30 on the base 10 and continued movement of the driver member 12 relative to the now fixed magazine causes the driver 25 to contact the outermost staple and drive the same through the guideway 19 and into operative engagement with an anvil. Release of the driver member 12 causes the initial reverse rotation of the driver member together with magazine 11 and thereafter the continued rotation of the driver member alone. The aforegoing description of the operation of the stapler apparatus is conventional and the described apparatus or any other similar apparatus may be utilized as an environment for the present invention.

Figure 2:
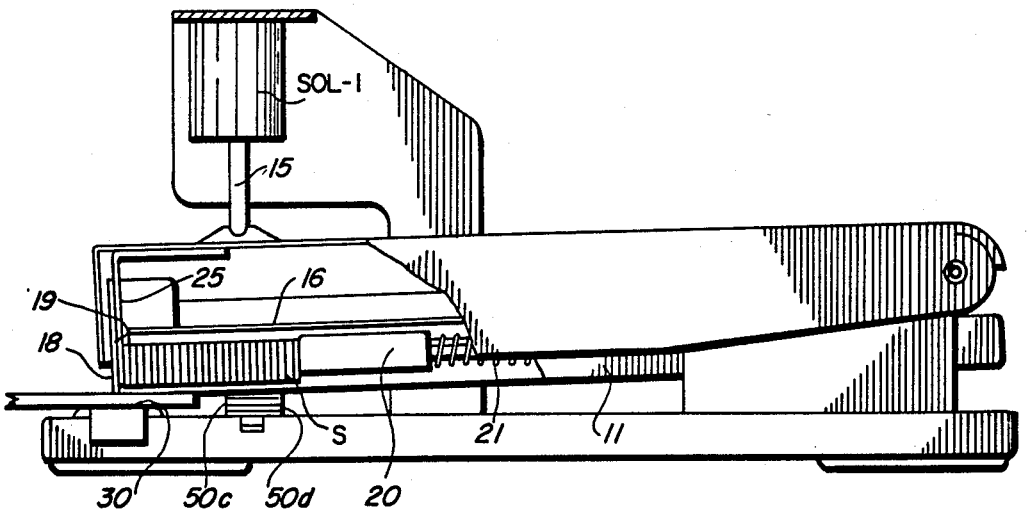
FIG. 2 is a side elevational view of the apparatus in FIG. 1 showing the operating lever and staple magazine in vertical alignment and in cooperation with the base member of the stapling apparatus.

As shown in FIGS. 1 and 2, the base 10 supports the passive clinching anvil 30 at its forward end, the anvil being formed with suitable clinching grooves of a shape and disposition for bending the legs of a staple inwardly.

In commercial stapling machines utilizing conventional passive clinching anvils, the use of staples having relatively long legs for stapling sets of paper having 25 or more sheets, when used also for sets having only a few sheets such as 2, 3, 4, or 5 sheets, repenetration of the legs of the staple back through the top sheet of the set being stapled occurs. To avoid repenetration, the operator must remove the long legged staples in the stapling machine being utilized and add staples having short legs which may accommodate the low number of sheets being stapled without re-entry of the legs tips into the set. If later the paper sets have a number of sheets say, on the order of 25 or more sheets, the operator must remove the short legged staples from the stapling apparatus and resupply the same with staples having long legs.

When the legs of the staple are pushed against the clinching grooves in the conventional anvil, deformation depends upon, besides the curvature of the grooves, the length of the legs measured from its tip to a support point along the leg. For a standard staple, when there are only 2, 3, 4, or 5 sheets stapled, the support point is the joint of the leg with the bridge of the staple. This length is relatively short and the tip portion of the leg begins to experience plastic deformation immediately upon the contact with the curve of the clinching grooves. This is also true for a long legged staple after the long leg penetrates a thick set of papers. In this situation, the paper set supports the leg and plastic deformation begins in a region relatively close to the tip of the leg. In both cases the anvil serves as a forming die in bending the legs of the staple. The leg is deformed plastically in a continuous manner and curled upward to press against the bottom surface of the paper set.

However, if the legs of the staple are long and there are only a few sheets being stapled, the support point of the leg is located far from the tip of the leg so that severe bending stress only appears at a considerable distance away from the tips. Hence, between the tips and the stress points, the leg remains almost straight and permanent deformation begins only after that point. As the staple continues its downward motion, the tips of the legs continue to slide toward the center of the anvil along the bottom of the clinching grooves. This motion increases the moment arm from the tips to the stress points until a plastic hinge appears and the leg suddenly collapses. Further downward motion of the legs will produce more permanent deformation in the legs while the straight portions of the legs may remain straight because the effective contact with the anvil may have moved farther back from the tips. After piercing the set when the stapling operation is completed, a large bent is formed and a straight portion of each of the legs points upwardly to effect penetration of the legs back through the sheets to the top sheet of the set.

The present invention serves as a remedy to limit the repenetration of the staple legs through the set. To this end, the stapling apparatus is provided with a stack 50 comprising a plurality of stops 50*a*, 50*b*, 50*c*, and 50*d* each in the form of a flat, rectangular element of a length which varies from the others. The stop elements are positioned one upon the other to form the stack 50 with one end of each in alignment so that a portion of each of the elements protrudes beyond the one above it, as shown in FIG. 3.

The stack 50 is arranged relative to the stapling apparatus so that each of the stop elements 50*a*, 50*b*, 50*c*, and 50*d* may be positioned between magazine 11 and the base member 10, and at a slight distance rearward of the anvil 30. Each of the stop elements serve as a means to limit the downward movement of the magazine 11, and consequently, the drive lever 12 when the latter is driven into the magazine to drive out a staple therefrom. The thickness of each of the stop elements and when combined with one or more of the other may be suitably dimensional so as to permit precise control of the limits to which the driver 25 is effective in its role in forming a staple. In effect, the stop elements limit the pivotal extent to which the magazine 11 is subjected relative to the base 10.

The stack 50 is adapted for transverse movement relative to the base 10 and magazine 11 by a gear/drive mechanism 52 having a drive element 53 connected along the bottom side of the stack 50. The drive element may be in the form of a gear rack which cooperates with a gear (not shown) within the mechanism 52 to be driven in either direction by a suitable reversible motor.

Figure 3:
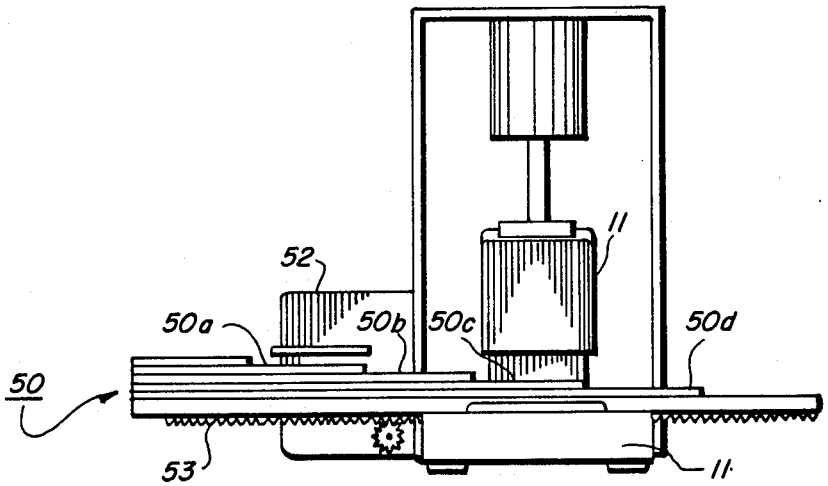
FIG. 3 is an end view of the apparatus of FIGS. 1 and 2.

As shown in FIGS. 2 and 3, the stop elements 50*d* and 50*c* are shown interposed between the magazine 11 and base member 10. Actuation of the mechanism 52 by a suitable operator-controlled circuit may be such as to position a portion of one or more of the stop elements selectively between the base member and magazine. The mechanism 52 is preferably adapted to effect incremental movement of the stack in either direction so that the steps of the stack, as defined by the exposed portions of one or more of the stop elements, are positioned between the magazine and the base member. With the number of illustrated stop elements totalling four, there are four step portions and therefore four incremental movements adapted to be imposed upon the stack in any one direction. The four step portions also allow four pivotal or angular relationships between the magazine 11 and the base member 10 during a stapling operation.

In operation, when any of the stop elements 50*a*, 50*b*, 50*c*, or 50*d* is below the magazine 11, and the downward pivotal movement of the magazine 11 and drive member 12 is thereby limited, a staple is correspondingly limited in its driven action relative to the anvil 30. This limited driver action imposed upon the staple will lessen the bending action imposed upon the legs of the staple by the clinching grooves in the anvil 30. This lessening of the bending formation of the staple legs prevent repenetration of the tip of the legs back through the set of sheets being stapled and through the top sheet of the set.

The thickness of the individual stop elements and the portion thereof between the magazine and base member, are such as to be coordinated with the appropriate number of sheets in a set so as not to result in repenetration. For example, the presence of all four stop elements between the pivotal members may be utilized when 2, 3, 4, or 5 sheets are in a set to be stapled. On the other hand, with only the stop element 50*d* being so positioned, a set of 25 sheets may be stapled with the same size staple as was utilized in the former example. It is preferred that the latter example, that is, the use of at least the stop element 50*d*, be indicative of the largest set possible with the stapling apparatus.

While four stop elements have been illustrated thus making available four possible staple leg deformations, it will be understood that these numbers are only illustrative. It will be understood that more or less numbers of steps of limitation may be utilized. In its broadest sense, the present invention may include only one applicable stop element as an improvement for stapling apparatus which normally does not include means selectively applicable to limit pivotal movement of its driven member. In this arrangement, the improved stapling apparatus will be adapted to operate in two modes when utilizing the same size of long legged staples, namely, with no stop applied for a large number of sheets in a set, say on the order of 25 sheets or with stop applied when stapling sets having 2, 3, 4, or 5 sheets, in order to prevent repenetration.

From the foregoing, it will be appreciated that the present invention is an improvement of conventional staplers which will permit the use of a single sized staple for stapling sets of paper sheets ranging between 2, 3, 4, or 5 sheets per set to sets containing 25 or more sheets. It will also be appreciated that this use of a single staple for a relatively wide range of thicknesses of paper sets to be stapled is readily available at very minimal cost both in parts and in engineering effort in modifying conventional stapling apparatus.

While the invention has been described with reference to the structure disclosed, it is not confined to the details set forth, but is intended to cover such modifications or changes as may come within the scope of the following claims.

I claim:

1. In a stapler apparatus of the type having a base member and a staple magazine member movable related toward each other during a stapling operation upon a set of sheets, the magazine member being provided at an end thereof with staple dispensing means, the base member being provided at an end thereof with an anvil member, the anvil member and the staple dispensing means being adapted to cooperate to permit individual ones of the staples to drive against the anvil member, to drive the staple legs through the sheets, and to deform the legs during a stapling operation when the base and magazine member are moved toward each other, the improvement including:

at least one stop member movable into a position between the base and the magazine members and being arranged to limit the relative movement therebetween and control the bending of the legs of the staple.

2. The apparatus of claim 1 including means for selectively moving said stop member into and out of said position.

3. The apparatus of claim 1 including a plurality of stop elements each being arranged to be moved into said position and having different limiting effects upon said relative movement.

* * * * *